United States Patent [19]

Yamazaki et al.

[11] 4,052,768

[45] Oct. 11, 1977

[54] HANDLE OF A WINDOW REGULATOR FOR VEHICLES

[75] Inventors: Takeo Yamazaki, Anjo; Kuniyoshi Harada, Toyota, both of Japan

[73] Assignee: Aisin Seiki Kabushiki Kaisha, Japan

[21] Appl. No.: 671,997

[22] Filed: Mar. 30, 1976

[30] Foreign Application Priority Data

Apr. 11, 1975 Japan ..... 50-44431

[51] Int. Cl.[2] ..... B25G 3/00

[52] U.S. Cl. ..... 16/121; 74/545

[58] Field of Search ..... 16/121, 118; 74/545; 403/289, 165

[56] References Cited

U.S. PATENT DOCUMENTS

| | | | |
|---|---|---|---|
| 434,295 | 8/1890 | Richardi | 403/289 |
| 2,978,927 | 4/1961 | Blanton | 74/545 |
| 3,071,023 | 1/1963 | Herr et al. | 16/121 X |
| 3,198,032 | 8/1965 | Pollak | 74/545 |

*Primary Examiner*—Andrew V. Kundrat

*Attorney, Agent, or Firm*—Oblon, Fisher, Spivak, McClelland & Maier

[57] ABSTRACT

A handle of a window regulator for vehicles includes a main body having a cylindrical projecting portion vertically extended from one end thereof and an opened shoulder portion formed on an inner end of the cylindrical projecting portion, and a knob member including a main body operatively attached to the one end of the main body of the handle, an annular groove formed in the main body of the knob member for inserting the cylindrical projecting portion of the main body of the handle thereinto, an extending portion vertically extended from the main body of the knob member for supporting the cylindrical portion of the main body of the handle, a bearing portion formed in an inner surface of the annular groove for bearing an outer surface of the projecting portion of the main body of the handle, a flange portion formed on one end of the extending portion for joining with the shoulder portion of the main body of the handle, and an axial slot formed in the extending portion and being capable of inwardly and elastically bending into a minimizing direction of the outer diameter of the flange portion.

7 Claims, 9 Drawing Figures

HANDLE OF A WINDOW REGULATOR FOR VEHICLES

BACKGROUND OF THE INVENTION

1. Field of the Invention:

The present invention relates generally to a window regulator for vehicles and more particularly to a handle of a window regulator for vehicles.

2. Description of the Prior Art:

Genrally, a longitudinal end portion of a main body of a handle is operatively connected to a drive shaft of a window regulator for vehicles and a bearing portion of a knob member is vertically and rotatably attached to the other end portion (operating portion) of the main body of the handle. The knob member of the window regulator is, therefore, jarred by the horizontal or slanting (transverse) load acting on the operating portion of the main body of the handle and comes out from the main body of the handle by the axial load upon operating the handle.

FIG. 2 shows a conventional handle of a window regulator wherein a knob 10 is so constructed into a main body 11 of a handle that a flange portion 12 has a larger diameter than that of a bearing portion 13 of the knob 10 and is mounted on a pointed end of a bearing portion 13 of the knob 10 inserted into a hole 14 of the main body 11 of the handle. An axial slit 15 is formed in an inner pointed end of the bearing portion 13 which is inwardly and elastically bent such that the joining assembly of the knob 10 into the main body 11 of the handle is accomplished by connecting the flange portion 12 of the knob 10 with a shoulder portion 16 of the main body 11 of the handle. However, since the outer diameter of the flange portion 12 of the knob 10 is larger than that of the hole 14 of the main body 11 of the handle, the joining assembly is difficult. Assuming that the slit 15 of the knob 10 is enlarged so as to easily construct the knob 10 into the main body of the handle, then the transverse load acting on the knob 10 upon operating the handle is received by the bearing portion 13 of the knob 10. Accordingly, the outer diameter of the flange portion 12 is varied by the above-mentioned transverse load upon operating the handle and the knob 10 may come out from the main body 11 of the handle. When the slit 15 of the knob 10 is minimized so as to eliminate the above-mentioned drawback, a large force for pressing the knob 10 into hole 14 of the main body 11 is required for the joining assembly, so that the flange portion 12 of the knob 10 is permanently transformed and the bearing portion 13 of the knob 10 may be cracked and the external appearance of the knob 10 may be remarkably injured by the large force required for pressing the knob 10 into the hole 14 of the main body 11.

In this invention, an outer surface of a cylindrical projecting portion mounted on a mian body of a handle and an inner surface of an annular slit formed in a knob member are tightly mutually joined for servicing as a bearing. Accordingly, the shaking between the main body of the handle and the knob member is eliminated and the transverse load is positively overcome. Furthermore, a shoulder portion formed in a tubular portion located below the cylindrical projecting portion of the main body of the handle and a flange portion shaped on a pointed end extended from a bearing portion of the knob are tightly mutually joined. Consequently, the knob is prevented from coming out from the main body of the handle.

SUMMARY OF THE INVENTION

It is an object of this invention to provide a handle of a window regulator for vehicles for obviating the above-mentioned conventional drawbacks.

It is another object of this invention to provide a unique and highly simplified handle of a window regulator for vehicles.

A more complete appreciation of the invention and many of the attendant advantages thereof will be readily apparent as the same becomes better understood by reference to the following detailed description, when considered in connection with the accompanying drawings.

BRIEF DESCRIPTION OF THE PREFERRED EMBODIMENTS

Figure 1:
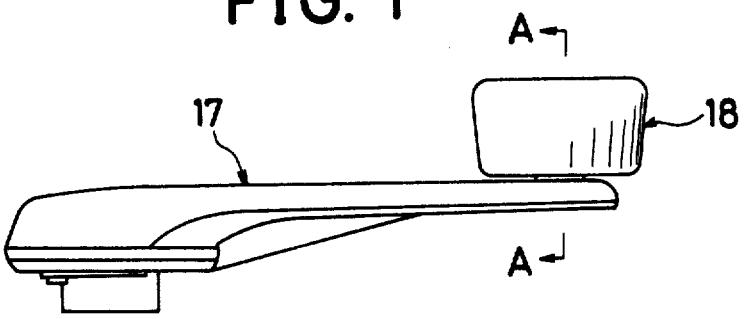
FIG. 1 is a summary view of a handle of a window regulator for vehicles.
Figure 2:
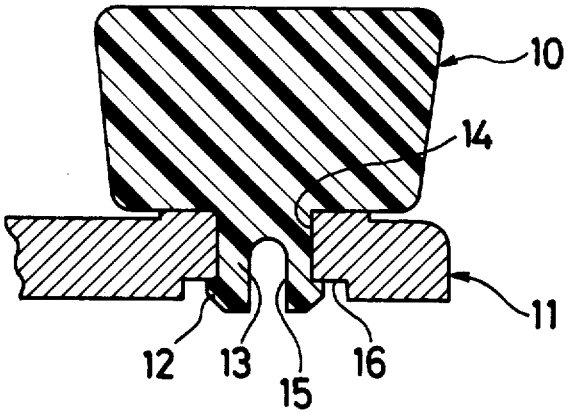
FIG. 2 PRIOR ART
FIG. 2 is a sectional view taken along the line A—A of FIG. 1, showing a conventional handle of a window regulator.
Figure 3:
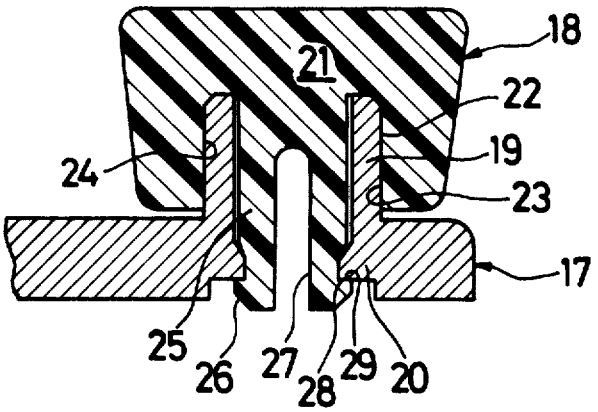
FIG. 3 is a similar view to FIG. 2, however, showing a handle of a window regulator according to this invention.

Referring now to the drawings, and more particularly to FIGS. 1 and 3 thereof, the reference number 17 refers to a main body of a handle having a longitudinal end portion operatively connected to a drive shaft of a window regulator with a knob 18 vertically attached to the other end of the main body 17 of the handle. An annular projecting portion 19 is upwardly projected from the other end of the main body 17 of the handle and an opened shoulder portion 20 is projected into the radial side at the lower fixed portion thereof. The reference number 18 refers to a knob which is, for example, made from plastic and includes a main body 21, an annular groove 24 having an inner surface 23 is connectable with an outer surface 22 of the projecting portion 19 and receives the projecting portion 19 formed in the main body 21 of the knob 18. An extending portion 25, downwardly extended in FIG. 3, has the same inner diameter with that of annular groove 24. A flange portion 26 is formed on the top end portion of the extending portion 25 and is connectable with the shoulder portion 20. A long slit 27 is formed axially from the pointed end of the extending portion 25 so as to elastically and radially-inwardly compress when the flange portion 26 is joined to the shoulder portion 20. The bearing operation is attained by the outer surface 22 of the projecting portion 19 and the annular groove 24 of knob 18 and the transverse load is positively overcome by the bearing operation.

The projecting portion 19 of the main body 17 of the handle is fixedly inserted into the annular groove 24 of knob 18 during the joining assembly, and the annular groove 24 of knob 18 and the projecting portion 19 of the main body 17 of the handle act as a guide during assembly until the extending portion 25 of the knob 18 passes through the inner side of the projecting portion 19 and the shoulder portion 20 of the main body 17 of the handle is contacted with the flange portion 26 of the knob 18. When the projecting portion 19 of the main body 17 of the handle is further inserted into the annular groove 24 of knob 18, the flange portion 26 is elastically moved in the direction for minimizing the diameter thereof by the effect of the long slit 27 and passes through the shoulder portion 20. Thereafter, the flange portion 26 is restored to the original shape to thereby join the assembly.

The operation according to FIG. 3 is described in detail as follows:

The knob 18 is integrally rotated with the main body 17 of the handle by revolution of one end portion of the main body 17 of the handle by gripping the main body 21 of knob 18 formed on the other portion of main body 17 of the handle. The window regulator (not shown) is driven by rotating a drive shaft, not shown. The knob 18 is rotated to rotate drive shaft (not shown). The knob 18 is attached to the other end of main body 17 of the handle, so when the knob 18 is rotated, the axial load (falling out direction of knob 18) and the transverse load are generated to the main body 17 of the handle. However, the axial load is received by connection between the flange portion 26 of the knob 18 and the transverse load is received by connection between the inner surface 23 of annular groove 24 of knob 18 and the outer surface of projecting portion 19 of the main body 17 of the handle. Since no transverse load acts on the extending portion 25 of knob 18 by the above-mentioned connection between the inner surface 23 of annular groove 24 of knob 18 and the outer surface of projecting portion of main body 17 of the handle, the extending portion 25 is not compressed. The axial displacement of knob 18 is prevented by the pointed end face of the projecting portion 19 of the main body 17 of the handle and the base of annular groove 24 of knob 18, and by a base 29 of shoulder portion 20 of main body 17 and an upper face 28 of flange portion 26 of knob 18.

Referring now to FIGS. 4–9, which illustrate different constructions from FIG. 3, will be described hereinbelow in detail, but not as to operation which is the same with FIG. 3.

Figure 4:
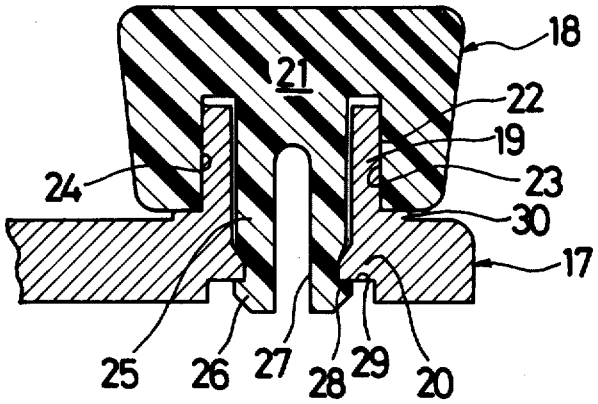
FIG. 4 is a similar view to FIG. 2, however, showing a second embodiment according to this invention.

In FIG. 4, a projecting portion 30 is provided so as to engage with the lower face of main body 21 of knob 18 and is mounted on the upper face of main body 17 of the handle to further remove the possibility of displacement.

Figure 5:
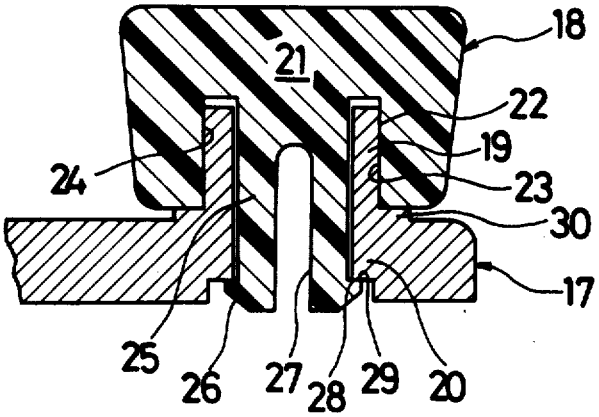
FIG. 5 is a similar view to FIG. 2, however, showing a third embodiment according to this invention.

In FIG. 5, the shape of shoulder portion 20 of main body 17 of the handle is simplified so as to be easily formed. The diameter of flange portion 26 of knob 18 is larger than that of extending portion 25.

Figure 6:
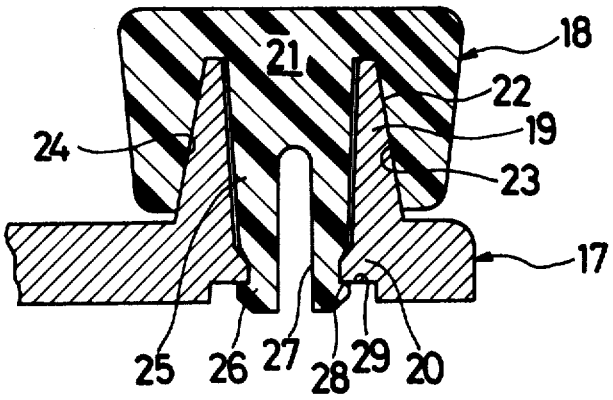
FIG. 6 is a similar view to FIG. 2, however, showing a fourth embodiment according to this invention.

In the embodiment of FIG. 6, slant engagement between the projecting portion 19 of the main body 17 of the handle and the annular groove 24 of knob 18 is illustrated.

Figure 7:
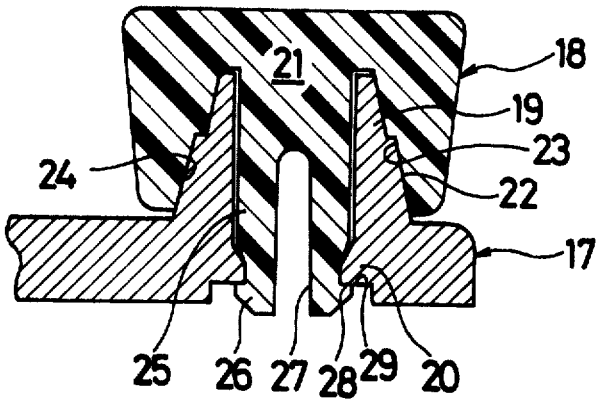
FIG. 7 is a similar view to FIG. 2, however, showing a fifth embodiment according to this invention.

In FIG. 7, stepped slant engagement between the projecting portion 19 of main body 16 of the handle and the annular groove 24 of knob 18 is illustrated; and the displacement between the main body 17 of the handle and the knob 18 is removed by the stepped portion and the shoulder portion 20 and the flange portion 26.

Figure 8:
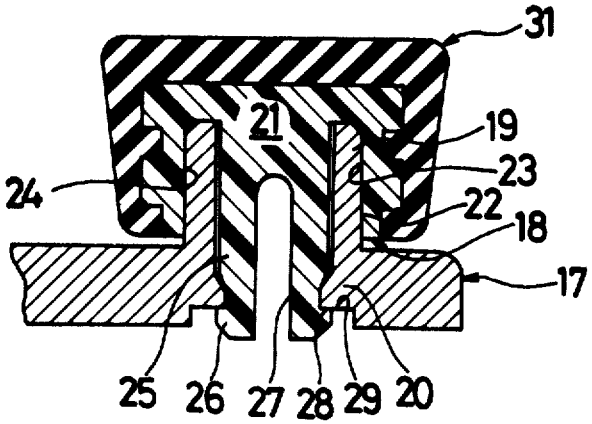
FIG. 8 is a similar view to FIG. 2, however, showing a sixth embodiment according to this invention.

In FIG. 8, a feeling member 31, for example, made from rubber material or the like, is provided to cover the outer face of main body 21 of knob 18 so as to improve the operating feeling.

Figure 9:
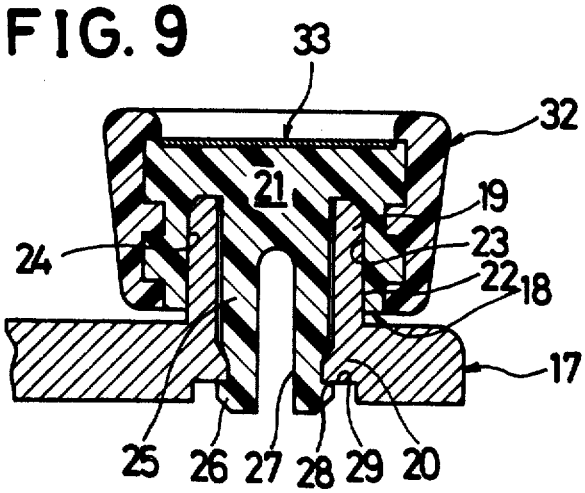
FIG. 9 is a similar view to FIG 2, however, showing a seventh embodiment according to this invention.

In FIG. 9, a stepped cylindrical feeling member 32 (made from rubber material or other elastic material) is provided to cover both side faces of main body 21 of knob 18 and an accessory plate, for example, made from stainless steel is attached to the upper face of main body 21 of knob 18.

Obviously, many modifications and variations of the present invention are possible in light of the above teachings. Is is therefore to be understood that within the scope of the appended claims the invention may be practiced otherwise than as specifically described herein.

What is claimed as new and desired to be secured by Letters Patent of the United States is:

1. A handle of a window regulator for vehicles, comprising a main body of a handle including a cylindrical projecting portion vertically extended from one end thereof and an opened shoulder portion formed on an inner end of said cylindrical projecting portion; and a knob member operatively attached to said one end of said main body of said handle comprises a knob member main body, an annular groove formed in said main body of said knob member for inserting said cylindrical projecting portion of said main body of said handle thereinto, an extending portion vertically extended from said main body of said knob member for supporting said cylindrical projecting portion of said main body of said handle, a bearing portion formed on an inner surface of said annular groove for bearing an outer surface of said projecting portion of said main body of said handle, a flange portion formed on an end of said extending portion for joining with said shoulder portion of said main body of said handle, the outer diameter of said flange portion being the same as or less than the outer diameter of said extending portion, and an axial slot formed in said extending portion and being capable of inwardly and elastically bending into a minimizing direction of the outer diameter of said flange portion.

2. A handle of a window regulator for vehicles as set forth in claim 1, further comprising:

a feeling member provided on an outer face of said main body of said knob member.

3. A handle of a window regulator for vehicles as set forth in claim 1, wherein said extending portion includes a recessed portion for engagement with said shoulder portion.

4. A handle of a window regulator for vehicles, comprising a main body of a handle including a cylindrical projecting portion vertically extended from one end thereof and an opened shoulder portion formed on an inner end of said cylindrical projecting portion; and a knob member operatively attached to said one end of said main body of said handle comprises a knob member main body, an annular groove formed in said main body of said knob member for inserting said cylindrical projecting portion of said main body of said handle thereinto, an extending portion vertically extended from said main body of said knob member for supporting said cylindrical projecting portion of said main body of said handle, a bearing portion formed on an inner surface of said annular groove for bearing an outer surface of said projecting portion of said main body of said handle, a flange portion formed on an end of said extending portion for joining with said shoulder portion of said main body of said handle, an axial slot formed in said extending portion and being capable of inwardly and elastically bending into a minimizing direction of the outer diameter of said flange portion; and a further projecting portion formed on said one end of said main body of said handle so as to contact with a lower face of said main body of said knob member.

5. A handle of a window regulator for vehicles, comprising:

a main body of a handle including a cylindrical projecting portion vertically extended from one end thereof and an opened shoulder portion formed on an inner end of said cylindrical projecting portion; and a knob member operatively attached to said one end of said main body of said handle comprises a knob member main body, an annular groove formed in said main body of said knob member for inserting said cylindrical projecting portion of said main body of said handle thereinto, an extending portion vertically extended from said main body of said knob member for supporting said cylindrical projecting portion of said body of said handle, a bearing portion formed on an inner surface of said annular groove for bearing an outer surface of said projecting portion of said main body of said handle, a flange portion formed on one end of said extending portion for joining with said shoulder portion of said main body of said handle, and an axial slot formed in said extending portion and being capable of inwardly and elastically bending into a minimizing direction of the outer diameter of said flange portion;

wherein said cylindrical projecting portion of said main body of said handle and said annular groove of said main body of said knob member are in slant engagement.

6. A handle of a window regulator for vehicles, comprising:

a main body of a handle including a cylindrical projecting portion vertically extended from one end thereof and an opened shoulder portion formed on an inner end of said cylindrical projecting portion; and a knob member operatively attached to said one end of said main body of said handle comprises a knob member main body, an annular groove formed in said main body of said knob member for inserting said cylindrical projecting portion of said main body of said handle thereinto, an extending portion vertically extended from said main body of said knob member for supporting said cylindrical projecting portion of said main body of said handle, a bearing portion formed on an inner surface of said annular groove for bearing an outer surface of said projecting portion of said main body of said handle, a flange portion formed on one end of said extending portion for joining with said shoulder portion of said main body of said handle, and an axial slot formed in said extending portion and being capable of inwardly and elastically bending into a minimizing direction of the outer diameter of said flange portion wherein said cylindrical projecting portion of said main body of said handle and said annular groove of said main body of said knob member are in stepped slant engagement.

7. A handle of a window regulator for vehicles; comprising:

a main body of a handle including a cylindrical projecting portion vertically extended from one end thereof and an opened shoulder portion formed on an inner end of said cylindrical projecting portion; and a knob member operatively attached to said one end of said main body of said handle comprises a knob member main body, an annular groove formed in said main body of said knob member for inserting said cylindrical projecting portion of said main body of said handle thereinto, an extending portion vertically extended from said main body of said knob member for supporting said cylindrical projecting portion of said main body of said handle, a bearing portion formed on an inner surface of said annular groove for bearing an outer surface of said projecting portion of said main body of said handle, a flange portion formed on one end of said extending portion for joining with said shoulder portion of said main body of said handle, an axial slot formed in said extending portion and being capable of inwardly and elastically bending into a minimizing direction of the outer diameter of said flange portion.

a stepped cylindrical-feeling member provided on both side faces of said main body of said knob member, and an accessory plate member mounted on an upper face of said main body of said knob member.

* * * * *